US006504563B2

(12) United States Patent
Kanai

(10) Patent No.: US 6,504,563 B2
(45) Date of Patent: Jan. 7, 2003

(54) LINE THERMAL PRINTER AND THERMAL HEAD

(75) Inventor: Masashi Kanai, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 09/760,043

(22) Filed: Jan. 12, 2001

(65) Prior Publication Data

US 2001/0012046 A1 Aug. 9, 2001

(30) Foreign Application Priority Data

Jan. 25, 2000 (JP) ..... 2000-016001

(51) Int. Cl.[7] ..... B41J 2/335
(52) U.S. Cl. ..... 347/209; 347/218
(58) Field of Search ..... 347/200, 201, 347/209, 218

(56) References Cited

FOREIGN PATENT DOCUMENTS

| | | | |
|---|---|---|---|
| JP | 8-80629 | * | 3/1996 |
| JP | 11-240189 | * | 9/1999 |

* cited by examiner

*Primary Examiner*—Huan Tran
(74) *Attorney, Agent, or Firm*—Adams & Wilks

(57) ABSTRACT

A thermal head has a base having a main surface, a first side, and a second side opposite the first side. At least one heating element is disposed on a portion of the main surface of the base with which a recording medium is brought into contact during a printing operation when the recording medium is transported from the first side to the second side of the base. At least one driver integrated circuit for driving the heating element during a printing operation is disposed in the vicinity of the heating element. An encapsulating resin covers the driver integrated circuit and protrudes from the main surface of the base at the second side thereof.

13 Claims, 3 Drawing Sheets

FIG.2A
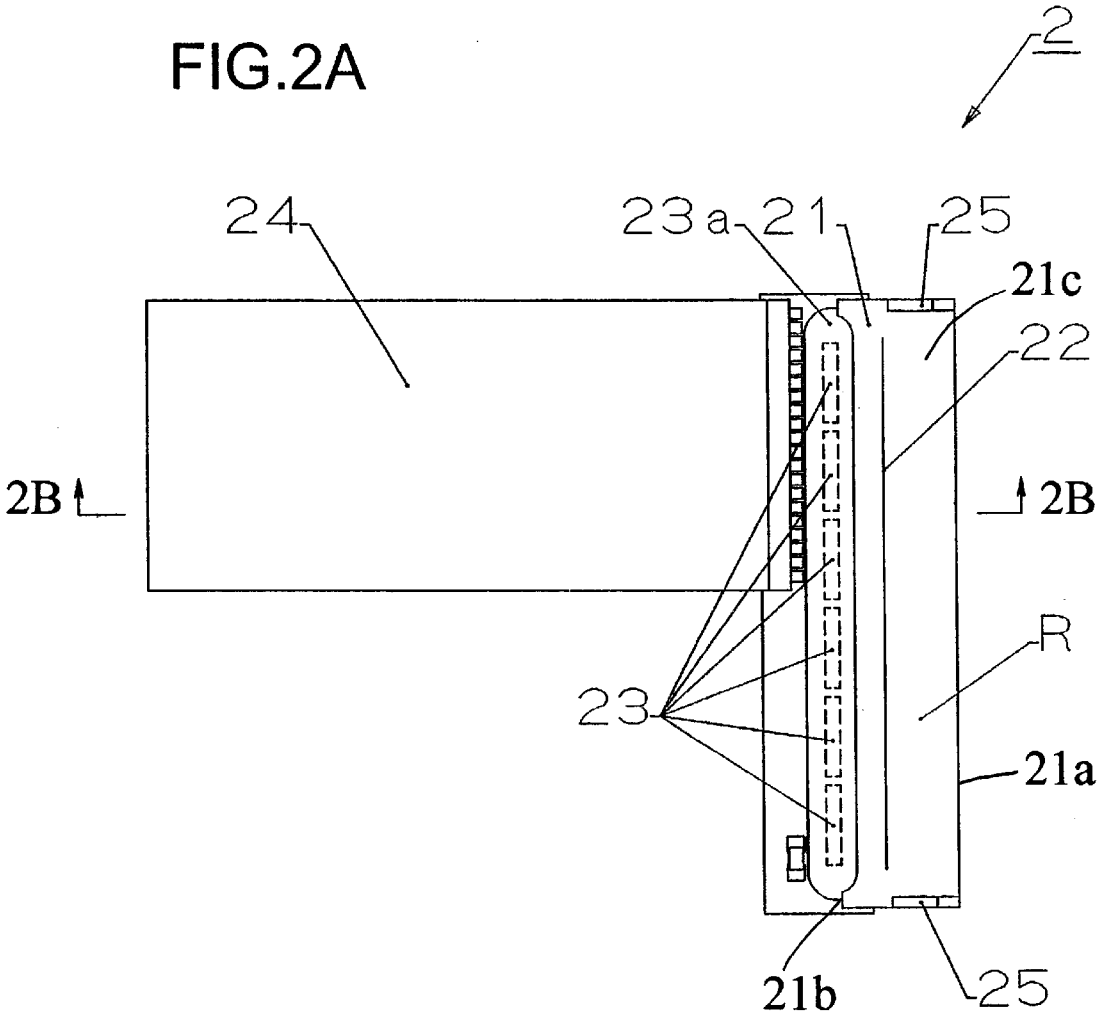
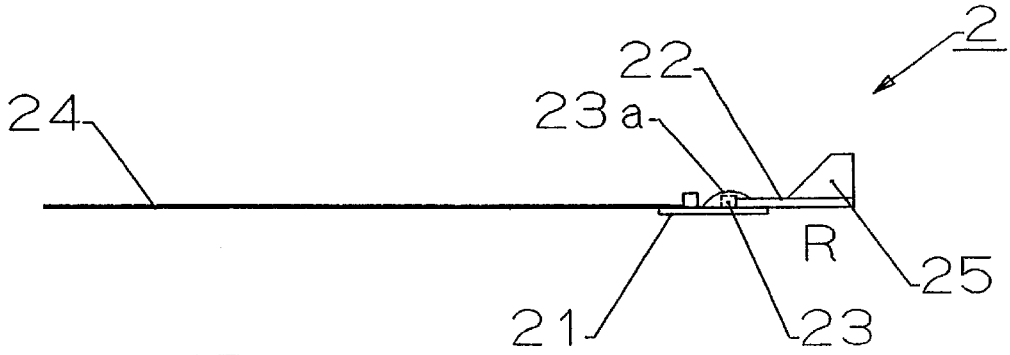
FIG.2B

FIG.3
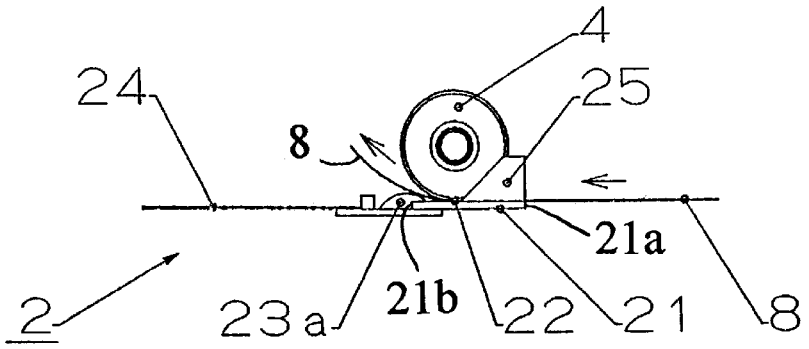
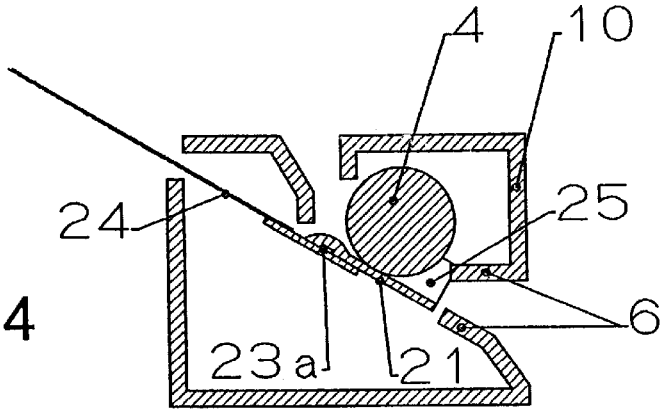
FIG.4
PRIOR ART
FIG.5
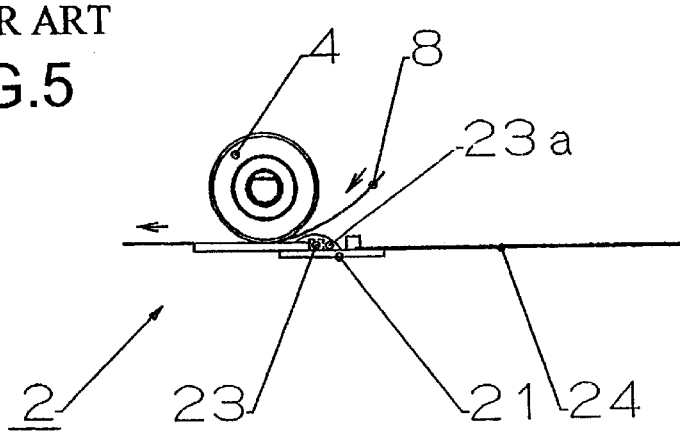

LINE THERMAL PRINTER AND THERMAL HEAD

BACKGROUND OF THE INVENTION

1. Field of the Invention

The present invention relates to a technique advantageously applicable to a thermal head having printing heating elements arranged in a row and driver circuits provided in the vicinity of the heating elements to drive the heating elements so as to make the heating elements develop heat, and also advantageously applicable to a line thermal printer having such a thermal head.

2. Description of the Related Art

A head the structure of which is shown in FIG. 5 is known as a thermal head of a line thermal printer for use in a cash register or the like. This thermal head 2 has heating elements 22 and driver integrated circuits (driver ICs) 23 for driving the heating elements 22 to develop heat. The heating elements 22 and the driver ICs 23 are arranged on an insulating substrate 21. A wiring film 24 for externally supplying power and signals to the driver ICs 23 is connected to the thermal head 2. The driver ICs 23 are embedded in a resin or the like. The thus-constructed thermal head 2 is placed so as to face a platen roller 4. Printing is performed on a printing sheet 8 by causing the heating elements 22 to develop heat while pressing the printing sheet 8 against the heating elements 22 by the platen roller 4 and intermittently feeding the printing sheet 8 by the platen roller 4.

In a line thermal printer using the above-described thermal head 2, the direction of transport of the printing sheet 8 relative to the thermal head 2 is such that the printing sheet 8 is passed through the nip between the heating elements 22 and the platen roller 4 from the side where a driver IC 23 embedding portion 23*a* exists to the side where the driver IC 23 embedding portion 23*a* does not exist.

In the thermal head using the above-described sheet transport method, however, it is not possible for the printing sheet 8 to advance to the heating elements 22 parallel to the head surface, i.e., the surface on which the heating elements 22 are arranged, since the driver IC 23 embedding portion 23*a* protrudes on the upstream side of the heating elements 22 with respect to the direction of transport of the printing sheet 8. As shown in FIG. 5, the sheet 8 is supplied obliquely downwardly to the printing position and is curved on the upstream side of the heating elements 22.

When printing is performed by using a comparatively thin and sufficiently flexible sheet, the printing sheet, fed obliquely downwardly as described above, becomes substantially parallel to the thermal head when passing the heating elements, so that printing can be normally performed. However, if printing is performed by using a thick paper or a hard printing sheet, the printing sheet fed obliquely downwardly cannot sufficiently closely contact the heating elements, resulting in occurrence of a printing failure such as a patchy condition.

SUMMARY OF THE INVENTION

In view of the above-described circumstances, the present invention has been made to overcome the drawbacks in the conventional art. It is therefore an object of the present invention to provide a thermal printer in which, even when a thick or hard printing sheet is used, the sheet and a thermal head are parallel to each other about the position on the heating elements, and which can therefore perform normal.

Another object is to provide a thermal head suitable for use in the thermal printer.

To achieve these objects, according to the present invention, there is provided a line thermal printer comprising a thermal head having printing heating elements arranged in a row, driver circuits for driving the heating elements, and an embedding portion in which the driver circuits are embedded portion in which the driver circuit are embedded protruding beyond a surface on which the heating elements are arranged, characterized in that the direction of transport of a printing sheet at the time of printing is set such that the printing sheet is passed through a place above the heating elements from the side where the embedding portion does not exist to the side where the embedding portion exists.

In the thus-constructed printer, the driver circuit embedding portion does not obstruct feed of a printing sheet to the thermal head, and the sheet feed direction can be set such that the angle from the surface on which the heating elements are arranged is substantially zero, that is, the direction can be set substantially parallel to this surface. Therefore, even if a thick or hard printing sheet is used, it can be maintained parallel to the thermal head even downstream of the printing position in the sheet feed direction, and printing can be normally performed without a failure such as occurrence of a patchy condition.

If there is an embedding portion on the sheet entrance side of the head, the sheet insertion opening is reduced that much and there is a need to provide a sheet guide having an end located close to the nip between the platen roller and the thermal head in order to prevent a printing sheet from being caught by the embedding portion at the time of setting of the sheet. In the above-described printer, however, there is no embedding portion on the sheet entrance side, so that the sheet insertion opening can be increased. Thus, a simpler sheet guide may suffice for guiding a printing sheet to the increased sheet insertion opening.

Preferably, sheet guides for stopping sides of a printing sheet are provided on the side of the above-described thermal head where there is no embedding portion. Since there is no driver circuit embedding portion on the sheet inlet side, it is not necessary to largely extend, on the sheet inlet side, the head base on which the heating elements are arranged. Therefore, the portion for guiding a printing sheet to the heating elements may be reduced. However, a simple sheet guide may be provided on the sheet inlet side to enable a printing sheet to be easily led to the heating elements, as described above. Such a sheet guide comprises one having upper and lower members between which a sheet guide slot is formed.

Further preferably, the center of rotation of a platen roller used to transport a printing sheet while pressing the printing sheet in the vicinity of the heating elements is offset along a direction toward the embedding portion from a line extending from the heating elements perpendicularly to the surface on which the heating elements are arranged. When a printing sheet is introduced from the side where there is no embedding portion, the printing sheet is brought into contact with the embedding portion to be bent upwardly downstream of the printing position. Therefore, the possibility of occurrence of a patchy print may be considered. However, the above-described placement of the head and the platen roller ensures that any printing sheet can be maintained parallel to the thermal head even downstream of the printing position.

Further, a thermal head may be provided which has a base on which printing heating elements are arranged in a row, and on which driver circuits for driving the heating elements are formed, and an embedding portion in which the driver circuits are embedded, the embedding portion protruding beyond a surface on which the heating elements are arranged. In this thermal head, the distance between the row of the heating elements and the end of the base on the side where the embedding portion does not exist is set to 7 mm or more.

In the thus-constructed thermal head, when a printing sheet is led to the heating elements, the excess portion of the base at the side where there is no embedding portion can function as a sheet guide for introducing the printing sheet into the nip between the base and the platen roller, for example. Therefore, if this thermal head is used in a line thermal printer in which the direction of sheet transport at the time of printing is set such that a printing sheet is passed a place above the heating elements from the side where the embedding portion does not exist to the side where the embedding portion exists, the printing sheet can be led to the heating elements of the thermal head advantageously easily.

Further, a sheet guide for guiding a printing sheet from the side of the thermal head where the embedding portion does not exist to the heating elements may be provided on the side where the embedding portion does not exist, thereby achieving similar effect. Such a sheet guide comprises sheet guides for guiding sides of a printing sheet.

BRIEF DESCRIPTION OF THE DRAWINGS

In the accompanying drawings:

FIGS. 2A and 2B show the construction of a thermal head according to the preferred embodiment of the present invention, where FIG. 2A is a plan view and FIG. 2B is a cross-sectional view taken along line 2B—2B of FIG. 2A;

FIG. 3 is a cross-sectional view of an essential portion of the line thermal printer of the embodiment, showing the relationship among the thermal head, a platen roller, and a sheet transport path;

FIG. 4 is a cross-sectional view of an essential portion showing an example in the case where a main body case of the line thermal printer is provided with sheet guides; and FIG. 5 is a side view of a conventional thermal head, specially showing the direction in which a printing sheet is transported.

DETAILED DESCRIPTION OF THE PREFERRED EMBODIMENT

Figure 1:
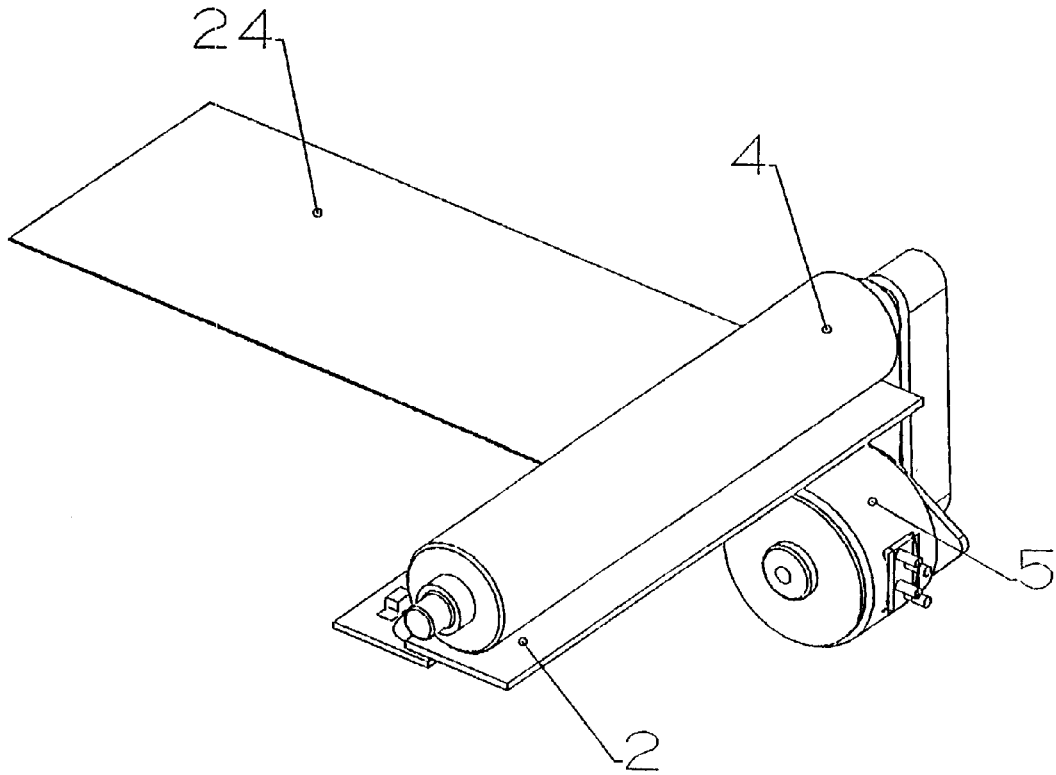
FIG. 1 is a perspective view of the structure of a printing unit of a line thermal printer according to a preferred embodiment of the present invention.

A preferred embodiment of the present invention will be described with reference to the accompanying drawings.

FIG. 1 is a perspective view of the structure of a printing unit of a line thermal printer according to a preferred embodiment of the present invention.

The line thermal printer of this embodiment is arranged to perform line-by-line printing by direct contact with a heat-sensitive sheet or by thermal transfer through an ink ribbon and by intermittently feeding the sheet in a direction perpendicular to the line along which dots are printed, thus performing two-dimensional printing on the printing sheet. The line thermal printer has the printing unit which includes, as shown in FIG. 1, a thermal head 2 having heating elements arranged in a row for printing of dots, a platen roller 4 for feeding a printing sheet while maintaining the sheet in contact with a portion of the thermal head 2 in which the heating elements are arrayed, and a motor 5 for rotational driving of the platen roller 4.

This line thermal printer may be provided with other well-known components (not shown), e.g., a sheet container for accommodating a continuous sheet such as a roll of paper, slips of paper, or the like, a sheet cutter for cutting, by a suitable length, a continuous sheet on which printing has been performed, and which has been unrolled from a roll, and a sheet transport mechanism for drawing out a sheet from the sheet container and for transporting the sheet to the outside of the printer through an outlet after passage along or through the thermal head and the sheet cutter.

FIGS. 2A and 2B show the construction of the thermal head according to the preferred embodiment of the present invention. FIG. 2A is a plan view and FIG. 2B is a cross-sectional view taken along the line 2B—2B of FIG. 2A.

The thermal head 2 has heating elements 22 formed of heating resistors for respectively printing dots. The heating elements 22 are arranged in a row on an insulating base 21 formed of a ceramic or the like and having a first side 21*a*, a second side 21*b* and a main surface 21*c*. Driver integrated circuits (driver ICs) 23 for causing currents to flow through the heating elements 22 to develop heat are provided on the same side of the base 21 and on one side of the row of the heating elements 22. A wiring film 24 with power supply conductors, signal conductors, and the like, is attached to the base 21 so that the conductors connect to the driver ICs 23. The driver ICs 23 are embedded or encapsulated in a resin material or the like forming an embedding portion 23*a*. The embedding portion 23*a* is formed on one side of the row of the heating elements 22 (i.e., on the second side 21*b* of the base 21) so as to protrude beyond the surface on which the heating elements 22 are provided.

The heating elements 22 are placed inside the base end at a distance of 7 mm or more. Because of this placement of the heating elements 22, an excess portion R of the base 21 between the heating elements 22 and the base 21 can function as a sheet guide for guiding a sheet into the nip between the platen roller 4 and the thermal head 2. At both sides of the excess portion R of the base 21, sheet guides 25 for guiding a sheet to the heating elements 22, which are not necessarily considered to be essential to this head, are provided so as to be able to contact the sides of the sheet to prevent the sheet from shifting in a transverse direction.

FIG. 3 is a cross-sectional view of an essential portion of the line thermal printer of this embodiment, showing the relationship among the thermal head, the platen roller, and a sheet transport path.

In the sheet transport path in the line thermal printer of this embodiment, the direction in which a recording medium such as a sheet 8 advances to the thermal head 2 is set such that the sheet 8 moves along the upper surface of the base 21 form the first side 21*a* which is opposite from the second side 21*b* at which the embedding portion 21*a* exist, and the direction substantially parallel to the upper surface of the base 21. The sheet 8 enters the nip between the platen roller 4 and the thermal head 2, and is transported by the platen roller 4 away from the nip while being slightly bent upwardly at the embedding portion 23*a* as if it averts the embedding portion 23*a*. Thereafter, the sheet 8 may be cut by a sheet cutter (not shown) before being discharged out of the printer.

The platen roller 4 is slightly offset from the position just above the heating elements 22 along the direction toward the embedding portion 23*a*. This placement enables the sheet 8 to be maintained in the state of being parallel to the upper surface of the base 21 when passing the heating elements 22 of the thermal head 2. After passing the heating elements 22 and after separating from the platen roller 4, the sheet 8 is slightly bent upwardly and obliquely relative to the base 21 surface so as to avert the embedding portion 23*a*.

If, as in the conventional arrangement, the direction of transport of the sheet 8 is set so as to feed the sheet 8 from the embedding portion 23*a* side while the same placement of the platen roller 4 is maintained, the sheet 8 is bent when advancing by being drawn by the platen roller 4, because it enters the nip between the platen roller 4 and the base 21 by advancing obliquely downwardly so as to avoid interference with the embedding portion 23*a*. If the sheet 8 is a thick or hard sheet, the sheet 8 curls along the peripheral surface of the platen roller 4 after being bent by the platen roller 4. Therefore, when the sheet 8 passes the point above the heating elements 22 after passing the nip on the platen roller 4, it is apt to rise slightly from the surface of the base, so that the contact pressure between the sheet 8 and the heating elements is not constantly high enough to avoid occurrence of an abnormal printing result, such as a patchy condition.

Even if the platen roller 4 is placed just above the heating elements 22 when the sheet 8 is fed in this direction, a similar defect cannot be avoided because the platen roller 4 is an elastic member. That is, if the sheet 8 is hard, it produces a force of moving the platen roller 4 upward. Thus, the contact pressure between the sheet 8 and the heating elements 22 is not uniform, resulting in occurrence of an abnormal printing result, such as a patchy condition.

However, the transport structure of the sheet 8 and the positional relationship between the platen roller 4 and the heating elements 22 ensure that the heating elements 22 and the sheet 8 can be maintained parallel to each other and can contact at a substantially constant pressure even downstream of the printing position irrespective of the thickness or hardness of the sheet 8, thus performing normal printing.

As described above, in the line thermal printer and the thermal head 2 of this embodiment, the embedding portion 23*a* of the driver ICs 23 has no adverse effect of obstructing supply of the printing sheet to the thermal head 2, and therefore, the direction of advancement of the sheet 8 can be set substantially parallel to the surface on which the heating elements 22 are provided. Therefore, even if a thick or hard printing sheet is used, it can be maintained parallel to the thermal head even downstream of the printing position, and printing can be normally performed without a failure such as occurrence of a patchy condition.

If the embedding portion 23*a* exists on the sheet entrance side, it is obstructive and reduces the sheet insertion opening. Thus, unless the sheet guide is placed close to the nip between the thermal head and the platen roller, the leading end of a sheet is brought into contact with the embedding portion 23*a*, which leads to a jam at the time of setting of the sheet. In contrast, in this embodiment, the sheet insertion opening can be increased by removing the embedding portion at the sheet entrance side, thus easily avoiding the above-described problem.

The heating elements 22 are disposed 7 mm or more inside the end of the base 21, and the sheet guides 25 that contact the sides of a printing sheet are provided at both sides of the excess portion of the base 21. Thus, enabling a printing sheet can be easily guided to the heating elements with a reduced possibility of jamming or the like.

Further, as shown in FIG. 4, sheet guides 6 may be provided on a main body case 10 instead of being provided on the head. In such a case, a type of guide structure can easily be made in which a printing sheet is guided by being introduced into the gap between upper and lower guide members.

The present invention has been described in detail in accordance with the embodiment thereof. However, the present invention is not limited to the described embodiment. For example, the head of the present invention is not limited to the type of thermal head having heating elements and driver ICs provided on the same surface of a base. The present invention can also be applied advantageously to a recently devised type of thermal head constructed such that the amount of protrusion of an embedding portion is slightly reduced by setting a small difference in level between the surface on which heating elements are provided and the surface on which driver ICs are provided.

In the described embodiment, the platen roller is offset from the position just above the heating elements along the direction toward the embedding portion. However, a certain effect of maintaining a printing sheet parallel to the thermal head even downstream of the printing position can be achieved even if the platen roller is placed just above the heating elements or offset in the reverse direction.

As described above, in the line thermal printer of the present invention, the driver circuit embedding portion is not obstructive to supply of a printing sheet to the thermal head, and the sheet supply direction can be set such that the angle from the surface on which the heating elements are provided is substantially zero, that is, the direction can be set parallel to this surface. Therefore, even if thick paper or a hard sheet is used as a printing sheet, the printing sheet can be maintained parallel to the thermal head even downstream of the printing position, and printing can be normally performed without a failure such as occurrence of a patchy condition.

Since there is no embedding portion on the sheet entrance side, the sheet insertion opening can be increased and simple paper guides may suffice for guiding a printing sheet.

The center of rotation of the platen roller is offset from the position just above the heating elements along the direction toward the embedding portion, thereby reliably maintaining a printing sheet parallel to the thermal head even downstream of the printing position.

In the thermal head of the present invention, a printing sheet can be easily guided to the heating elements of the thermal head in the case where the sheet transport direction is set such that during a printing operation the printing sheet is fed from the side where there is no embedding portion to the side where the embedding portion exists.

What is claimed is:

1. A line thermal printer comprising: a thermal head for printing on a printing sheet and comprised of a base having a first side and a second side opposite the first side, a plurality of printing heating elements disposed on a surface portion of the base between the first and second sides thereof, a plurality of driver circuits disposed in the vicinity of the heating elements for driving the heating elements, and an embedding portion in which the driver circuits are embedded, the embedding portion protruding beyond the surface of the base at the second side thereof; wherein a direction of transport of the printing sheet at the time of printing by the thermal head is set so that the printing sheet is fed over the printing heating elements from the first side of the base and is discharged from the second side of the base.

2. A line thermal printer according to claim 1; wherein the direction of transport of the printing sheet at the first side of the base is generally parallel to the surface of the base.

3. A line thermal printer according to claim 2; further comprising a platen roller mounted for undergoing rotation to transport the printing sheet from the first side of the base to the second side of the base while pressing the printing sheet against the surface of the base in the vicinity of the printing heating elements; wherein a center of rotation of the platen roller is offset along a direction toward the second side of the base from a line extending perpendicular to the surface portion of the base on which the printing heating elements are disposed.

4. A line thermal printer according to claim 1; further comprising sheet guides disposed on the first side of the base for guiding the printing sheet.

5. A line thermal printer according to claim 4; further comprising a platen roller mounted for undergoing rotation to transport the printing sheet from the first side of the base to the second side of the base while pressing the printing sheet against the surface of the base in the vicinity of the printing heating elements; wherein a center of rotation of the platen roller is offset along a direction toward the second side of the base from a line extending perpendicular to the surface portion of the base on which the printing heating elements are disposed.

6. A line thermal printer according to claim 1; further comprising a platen roller mounted for undergoing rotation to transport the printing sheet from the first side of the base to the second side of the base while pressing the printing sheet against the surface of the base in the vicinity of the printing heating elements; wherein a center of rotation of the platen roller is offset along a direction toward the second side of the base from a line extending perpendicular to the surface portion of the base on which the printing heating elements are disposed.

7. A line thermal printer according to claim 1; further comprising sheet guides disposed on the first side of the base for guiding side edges of the printing sheet.

8. A line thermal printer comprising: a thermal head comprised of a base having a first side and a second side opposite the first side, at least one heating element disposed on a surface portion of the base, and at least one driver integrated circuit extending from the second side of the base for driving the heating element; and a platen roller mounted for undergoing rotation to transport a recording medium over the heating element from the first side to the second side of the base, the platen roller having a center of rotation which is offset along a direction toward the second side of the base from a line extending perpendicular to the surface portion of the base on which the heating element is disposed.

9. A line thermal printer according to claim 8; further comprising a pair of guides disposed at the first side of the base for guiding the recording medium when the recording medium is transported by the platen roller.

10. A line thermal printer according to claim 8; further comprising a case supporting the thermal head and the platen roller, the case having a pair of guide members disposed at the firs t side of the base of the thermal head for guiding the recording medium when the recording medium is transported by the platen roller.

11. A line thermal printer according to claim 8; wherein the heating element is disposed at a distance of at least 7 mm from an end of the base at the first side thereof.

12. A line thermal printer according to claim 8; wherein the driver integrated circuit is covered by an encapsulating resin.

13. A line thermal printer according to claim 12; wherein the encapsulating resin protrudes from the surface of the base at the second side thereof.

* * * * *